US005162700A

United States Patent [19]

Soileau

[11] Patent Number: 5,162,700

[45] Date of Patent: Nov. 10, 1992

[54] CONTROLLABLE BALLAST AND OPERATING SYSTEM UTILIZING SAME

[75] Inventor: Trasimond A. Soileau, Flat Rock, N.C.

[73] Assignee: General Electric Company, Cleveland, Ohio

[21] Appl. No.: 708,577

[22] Filed: May 31, 1991

[51] Int. Cl.[5] ..... H05B 37/00

[52] U.S. Cl. ..... 315/151; 315/284; 315/311; 315/DIG. 7

[58] Field of Search ..... 315/150, 151, 158, 159, 315/284, 291, 307, 311, DIG. 7

[56] References Cited

U.S. PATENT DOCUMENTS 4,197,485 4/1980 Nuver ..... 315/284 X 4,431,947 2/1984 Ferriss et al. ..... 315/151

*Primary Examiner*—Robert J. Pascal

[57] ABSTRACT

This reactor ballast is used for controlling a lamp and comprises a core and winding connected in circuit with the lamp and inductively coupled to the core for developing a magnetic field in the core when the winding is traversed by electric current. The core forms a magnetic circuit for the magnetic field comprising two parts in series with each other in the magnetic circuit, one part being of metallic magnetic material and the other being of ferrite material. A control arrangement is provided for varying the temperature of at least a portion of the ferrite part in a predetermined temperature range just below the Curie point of the ferrite material where its relative permeability decreases steeply in response to small temperature increases. This temperature-varying arrangement comprises (a) a heating device in heat-exchange relationship with the ferrite portion and (b) control arrangement for causing the heating device to raise the temperature of the ferrite portion within said predetermined temperature range in response to predetermined system conditions and for causing the temperature of the ferrite portion to decrease within said predetermined range in response to other system conditions, thereby controlling the inductance of the reactor ballast and, as a result, controlling the performance of the lamp.

20 Claims, 5 Drawing Sheets

CONTROLLABLE BALLAST AND OPERATING SYSTEM UTILIZING SAME

FIELD OF THE INVENTION

This invention relates to a controllable ballast that comprises a core having a portion made of a low-Curie point magnetic material which is heated and cooled in a predetermined temperature range near its Curie point to control the inductance of the ballast. The invention also relates to an operating system that includes control means utilizing such a ballast to control a predetermined parameter of the operating system.

BACKGROUND

Most magnetic materials are characterized by a relative permeability which decreases comparatively steeply when heated into a predetermined temperature range just below the Curie point of the magnetic material. In most such materials the relative permeability can again be increased by cooling the material toward the lower limit of this predetermined temperature range. Certain magnetic materials, such as certain ferrites, have a low enough Curie point and sufficient sensitivity to enable this characteristic to be conveniently and effectively utilized for effecting rapid changes in the inductance of a ballast.

OBJECTS

An object of my invention is to provide a ballast that comprises a magnetic core having a portion that is alternately heated and cooled in a temperature range near its Curie point to effect rapid changes in the inductance of the ballast.

Another object is to provide a control system that includes a ballast of the type set forth in the immediately-preceding paragraph and which relies upon inductance changes produced by temperature changes of the magnetic core portion in a temperature range near its Curie point for regulating an operating system.

Still another object is to provide a control system of the type set forth in the immediately-preceding paragraph which can be used for controlling an electric lamp in such a manner that the light output of the lamp is maintained substantially constant despite variations in input quantities or other properties of the lamp operating system or the lamp.

Still another object is to provide a control system of the type referred to in the second object hereinabove which can be used for controlling an electric lamp in such a manner that the lamp power is maintained substantially constant despite variations in input quantities or other properties of the lamp operating system or the lamp.

Still another object is to provide a control system of the type set forth in the second object hereinabove which relies upon intermittent current pulses to heat the magnetic core portion and is capable of effectively regulating an operating system despite variations in the shape or frequency of the current pulses.

SUMMARY

In carrying out the invention in one form, I provide a lighting system that comprises (a) a lamp through which current flows to operate the lamp, (b) a reactor ballast comprising a core and a winding inductively coupled to the core for developing a magnetic field in the core when the winding is traversed by electric current, and (c) means for connecting the winding in circuit with the lamp. The core forms a magnetic circuit for said magnetic field comprising two parts in series with each other in the magnetic circuit, one part being of metallic material and the other being of a low Curie point material such as a suitable ferrite. Means is provided for varying the temperature of at least a portion of the ferrite part in a predetermined temperature range just below the Curie point of the ferrite material where its relative permeability decreases steeply in response to small temperature increases. This temperature-varying means comprises: (a) heating means in heat-exchange relationship with the ferrite portion and (b) control means for causing the heating means to raise the temperature of the ferrite portion within said predetermined temperature range in response to predetermined system conditions and for causing the temperature of the ferrite portion to decrease within said predetermined range in response to other predetermined system conditions, thereby controlling the inductance of the reactor ballast and, as a result, controlling the performance of the lamp.

BRIEF DESCRIPTION OF FIGURES

For a better understanding of the invention, reference may be had to the following detailed description taken in connection with the accompanying drawings, wherein.

DETAILED DESCRIPTION OF EMBODIMENTS

Figure 1A:
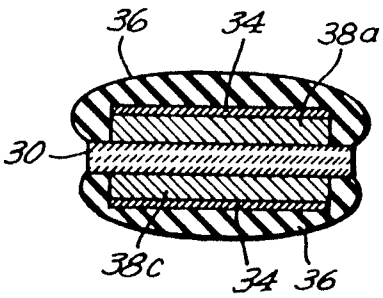
FIG. 1*a* is a cross-sectional view along the line 1*a*–1*a* of FIG. 1.
Figure 1:
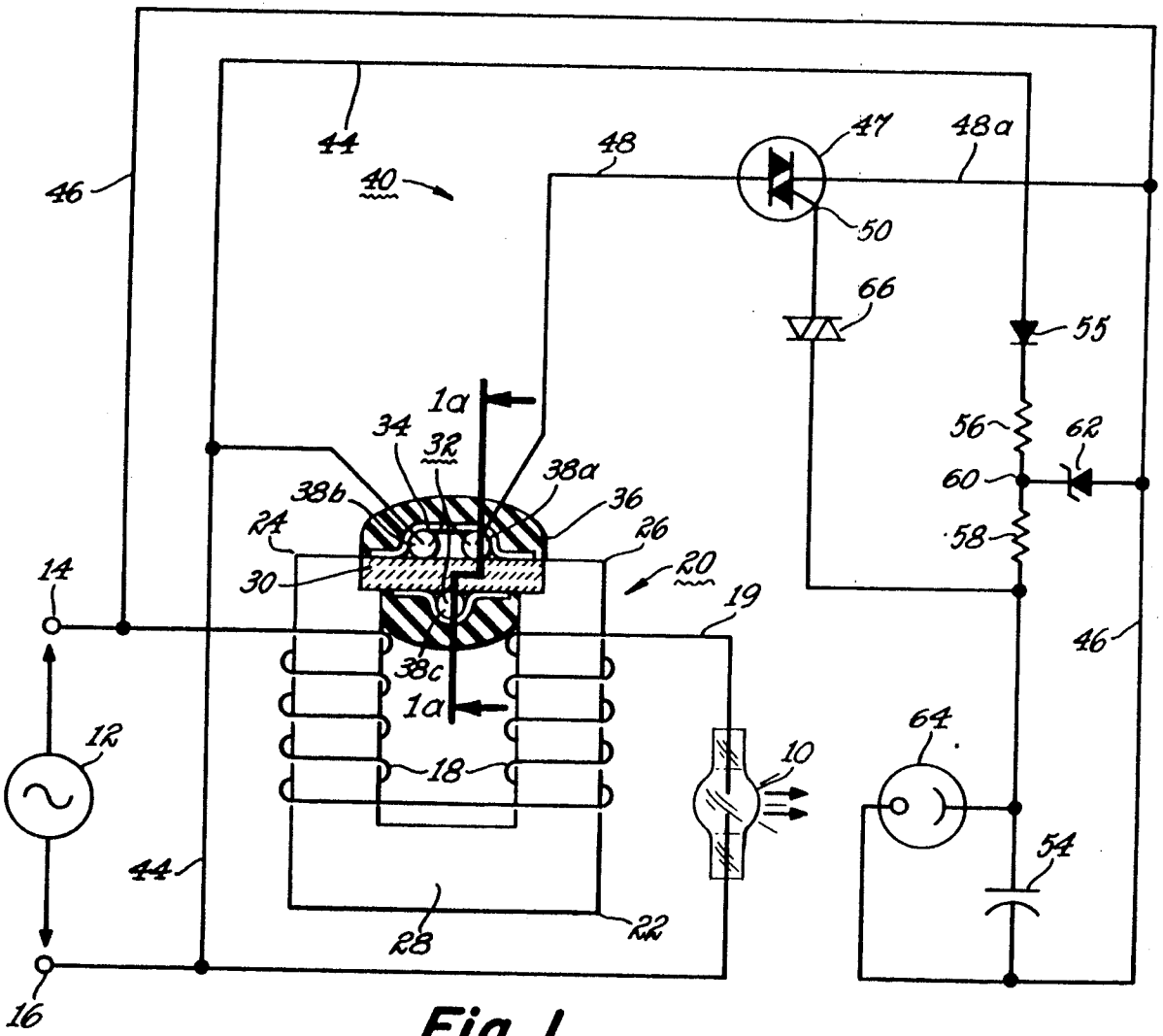
FIG. 1 is a diagrammatic showing of a lamp operating system including a control system embodying one form of my invention.

The Embodiment of FIG. 1

Referring now to FIG. 1, there is shown an electric lamp 10 of the gaseous discharge type, e.g., a high pressure sodium lamp, that is energized from a source 12 of a.c. voltage comprising terminals 14 and 16. Connected in series with lamp 10 across the voltage source 12 is the coil 18 of a reactor ballast 20. The reactor ballast serves in a conventional manner during lamp operation to stabilize the arc within the lamp, e.g., by supplying energy to promote transition between the glow state and the arcing state, to preclude premature extinction of the arc, and to limit current through the arc. The circuit 19 through the lamp 10 and the reactor ballast coil 18 is sometimes referred to hereinafter as the power circuit or the lamp circuit.

The reactor ballast 20 comprises a magnetic core 22 that comprises two spaced-apart legs 24 and 26 and two yokes 28 and 30 respectively located at opposite ends of the legs. In the illustrated embodiment the legs 24 and 26 and the lower yoke 28 are of common metallic magnetic material such as silicon steel containing 3 percent silicon, and the upper yoke is of a ferrite material, e.g., the material available from TDK Electronics Co., Ltd., Tokyo, Japan, as its TC-90 ferrite material. In a specific embodiment of the invention that I have built and tested, I employed for the ferrite yoke a slab of ferrite material designated by TDK as its sample reference number IZ83E598, dated Apr. 25, 1979. Other suitable ferrite materials with low Curie points, including conventional ones, are equally usable for this application. I can also use for the upper yoke, instead of the ferrite material, other suitable metallic magnetic materials that have a low Curie point, such as an iron-cerium compound ($Fe_2Ce$) having a Curie point of 116 degrees C. or a colbalt-zinc compound (CoZn) having a Curie point of 125 degrees C.

The lower yoke 28 is integral with the two legs 24 and 26 to form a U-shaped structure, and this structure is preferably formed of stacked U-shaped laminations. The upper yoke 30 bridges the gap between the two legs, preferably being bonded or otherwise secured to the two legs at its opposite ends. The coil 18 is inductively coupled to the core, being suitably wound about both legs thereof.

In the illustrated embodiment of the invention, the silicon steel of the legs and lower yoke has a Curie point of about 760 degrees C., and the TC-90 ferrite material of the upper yoke 30 has a Curie point of about 89 degrees C. Means is provided for varying the temperature of this ferrite yoke in a predetermined temperature range of about 4 degrees C. just below its Curie point. Referring to FIG. 1, this temperature-varying means comprises a heating element 32 adjacent the ferrite yoke, two sheets 34 of good heat-conducting material at the upper and lower faces of the yoke and extending along the yoke on opposite sides of the heating element, and a jacket 36 of good thermal insulating material encapsulating the heating element and the sheets 34. The heating element 32 can take a number of different forms (e.g., one or more suitably shaped carbon resistors in close proximity to one or more faces of the yoke or a coil of resistance wire surrounding the yoke). Alternatively, the heater element could take the form of a film coated onto the ferrite member to provide good contact between the heater and the ferrite member. In the illustrated embodiment of the invention, the heating element 32 has a resistance of 280 ohms, the sheets 34 are of copper, and the insulating jacket is of a suitable silicone rubber. The sheets 34 serve to distribute the heat developed by the heating element 32 over a substantial portion of the length of the ferrite yoke, and the insulating jacket reduces heat loss to the surrounding ambient, thereby providing more efficient heat transfer to the yoke.

The specific heating element 32 of FIGS. 1 and 1*a* comprises two carbon resistors 38*a* and 38*b* mounted atop the yoke and a third carbon resistor 38*c* mounted beneath the yoke. These resistors are connected in series by suitable conductors (not shown). Each of the copper sheets 34 has a recess formed therein to receive the associated resistor(s).

The inductive reactance of the reactor 20 depends upon the temperature of the ferrite yoke 30. Assuming that the ferrite material of the yoke is the particular TC-90 ferrite material referred to hereinabove, its relative permeability will vary with temperature changes approximately in accordance with the curve of FIG. 4. Referring to this curve, when the temperature of the material is 80 degrees C. or below, its relative permeability remains at an approximately constant value of about 3000. When its temperature is increased from 80 degrees C. to 85 degrees C., its relative permeability decreases slightly to about 2600. But in the range of about 85 degrees C.–89 degrees C., its relative permeability decreases very steeply until at the Curie point of about 89 degrees C, the ferrite material has completely lost that portion of its relative permeability exceeding unity. Assuming now that the ferrite core is operated at a quiescent control temperature within this narrow range (85–89 degrees C.) just below the Curie point and, more particularly, at about 87.5 degrees C., it will be apparent that a small temperature increase above the quiescent control temperature will produce a relatively large decrease in relative permeability. As the increasing temperature nears the Curie point, the permeability decreases to such an extent that the inductive reactance of the reactor approximates that of a reactor correspohding to reactor 20 but having an air gap where the ferrite yoke 30 is located. If the temperature of the ferrite element is decreased while within the above-described 85 to 89 degrees C. temperature range, its relative permeability greatly increases in accordance with the uphill slope of the curve of FIG. 4 in the 85–89 degrees C. temperature range.

The heating element 32 is arranged to be intermittently energized from a control circuit 40 connected across the a.c. terminals 14 and 16 of the power circuit. Control circuit 40 comprises a first bus 44 and a second bus 46. The heating element 32 is connected between these two buses 44 and 46 through a solid-state switching device 47, preferably a triac, by means of a heating circuit 48.

The triac 47 is normally non-conducting, but it can be rendered conducting (or fired) by applying a triggering signal to its gate 50. Current then flows through the anode-cathode circuit of the triac until a natural current zero is reached, whereupon the triac returns to its normal non-conducting state if there is then no triggering signal flowing through gate 50.

Figure 4:
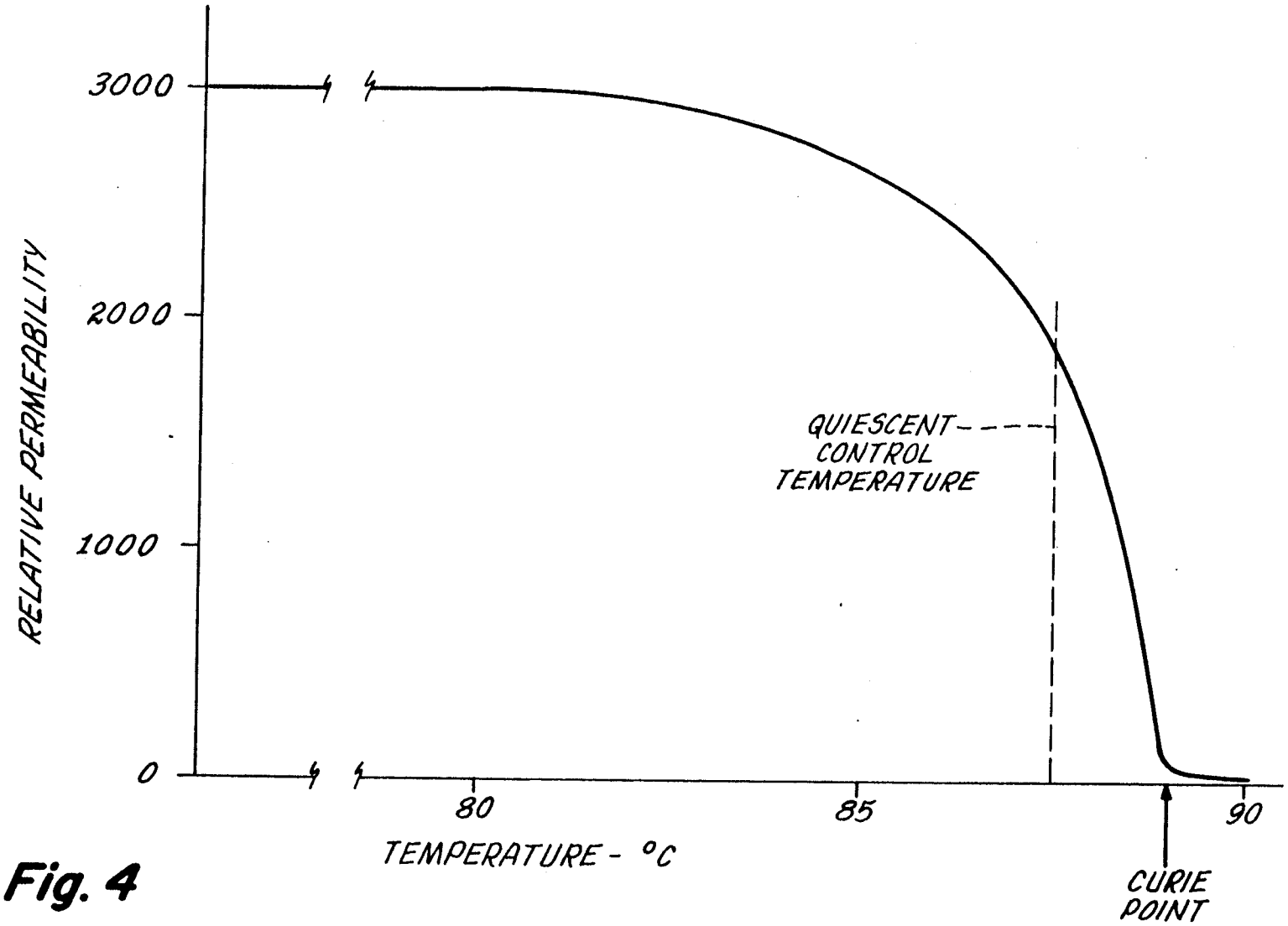
FIG. 4 is a graph illustrating certain characteristics of a ferrite material used in the ballasts contained in the systems of FIGS. 1–3. More specifically, this graph shows the permeability of the ferrite material plotted against temperature.

Under steady-state conditions, the triac is fired at regular intervals, causing the resulting current pulses through the heating element 32 to heat the ferrite yoke to a temperature $T_1$, which corresponds to the quiescent control temperature of FIG. 4. The ferrite temperature at $T_1$ sets the reactance of the ballast 20 at a value $X_L$, causing the lamp 10 to draw power $P_1$ which, in turn, develops a light output of $L_1$ lumens, Under steady-state conditions, the light output from the lamp is maintained at $L_1$.

For controlling the triac 47 in the above-described manner, I provide the series combination of a timing capacitor 54, two resistors 56 and 58, and a rectifying diode 55 connected across the buses 44 and 46. A Zener diode 62 is connected between a junction point 60 between the two resistors 56 and 58 and a second point located on bus 46. This Zener diode clamps at a fixed voltage, e.g., 13 volts, between these two points. Also connected across the capacitor 54 is a photocell 64 that is positioned to receive light from the lamp 10. The photocell provides a resistance connected across the capacitor 54 that remains essentially constant so long as the lumens received by the photocell from the lamp 10 remains constant. Should the lumens decrease, this resistance will increase; and, conversely, should the lumens increase, this resistance will decrease. In one embodiment, this photocell is of the cadmium sulfide type.

So long as the lumens received by the photocell 64 from the lamp remain constant, the triac 47 is turned on and off at regular intervals, generating pulses, successive ones of which are separated from each other by no-current intervals of sufficient duration to maintain the ferrite yoke at the above-described temperature $T_1$. Firing of the triac occurs when the voltage across the capacitor 54 reaches a predetermined value, causing a normally non-conductive breakdown device 66, (e.g., a silicon bilateral switch, or SBS) to avalanche and establish a low resistance path between the upper terminal of capacitor 54 and the gate 50 of the triac. When this occurs, the capacitor 54 discharges through this path and the portion 48*a* of the circuit 48, thereby firing the triac 47. Such firing completes circuit 48 through heating element 32, causing a pulse of current to pass through the heating element 32.

After the above-described avalanching of the breakdown device 66, the capacitor 54 is able to quickly discharge to a low voltage sufficient to enable the breakdown device to recover its non-conducting properties and block further current through gate 50 of the triac. Accordingly, when the triac 47 has passed a half-cycle pulse of power frequency current from source 12 and the voltage across the triac reverses, there is no trigger signal then passing through the gate 50. As a result, upon completion of the pulse, the triac turns off.

When the triac 47 is thus turned off, the capacitor 54 is recharged through the resistors 56 and 58, such recharging continuing until the breakdown device 66 again avalanches, thereby again causing the triac 47 to fire, thus repeating the above cycle. The time between successive firings of the triac is controlled by the RC time constant of the circuit 58, 54, 64, the voltage across this circuit being held constant by the Zener diode 62. Assuming a constant value of lumens reaching the photocell 64 and a constant voltage across the circuit 58, 54, 64, the no-current intervals between pulses through the triac 47 and the heating coil 32 will be of substantially the same length and of a value to maintain the lumens output of the lamp 10 at the above-described value $L_1$.

If any parameter in the power circuit should change and cause the lumens output of the lamp 10 to change, this system will automatically self-correct to continue giving constant lumens. For example, if the a.c. line voltage between terminals 14 and 16 were to increase, the voltage at point 60, which is controlled by the Zener diode 62, would remain clamped (at 13 volts in this embodiment); but the voltage across the heating element 32 would increase, causing each "on time" pulse through the heating element to be more energetic, thus tending to increase the heating element temperature. A small increase in the heating element temperature would heat the ferrite yoke 30 to a higher temperature $T_2$. This hotter ferrite yoke 30 would lower the ballast's inductive reactance, tending to allow more power through the lamp 10. More power through the lamp results in a greater lumens output $L_2$. The increased lumens impinge on the photocell 64, lowering its resistance, and thus causing more charging current to be bled off from the timing capacitor 54 so that now the breakdown device 66 is fired at a slower rate, thus increasing the length of time between successive pulses through the heater element 32. Thus, there are now stronger heating pulses but fewer of them so that the net effect is actually a slight lowering of the temperature of the ferrite yoke 30 and a slight increase in the inductive reactance of the reactor which is just sufficient to keep the lumens essentially constant despite the increased line voltage. This is in distinct contrast to a normal lamp circuit containing an uncontrolled reactor, where increasing the line voltage by 5% will typically give a 13% increase in lamp watts and lumens.

In one particular embodiment of the system illustrated in FIG. 1, I have used components having the following properties, which are given strictly by way of example and not limitation:

| | |
|---|---|
| Voltage of source 12 | 12 volts a.c. |
| Rated wattage of lamp 10 | 50 watts |
| Resistance of heating element 32 | 235 ohms |
| Resistance of: | |
| resistor 56 | 10 kilo-ohms |
| resistor 58 | 39 kilo-ohms |
| Capacitance of capacitor 54 | .015 microfarads |
| Breakdown voltage of Zener diode 62 | 13 volts |
| Breakdown device 66 | silicon bilateral switch (SBS) |
| Switching device 47 | triac |
| Photocell 64 | cadmium sulfide type |

Figure 2:
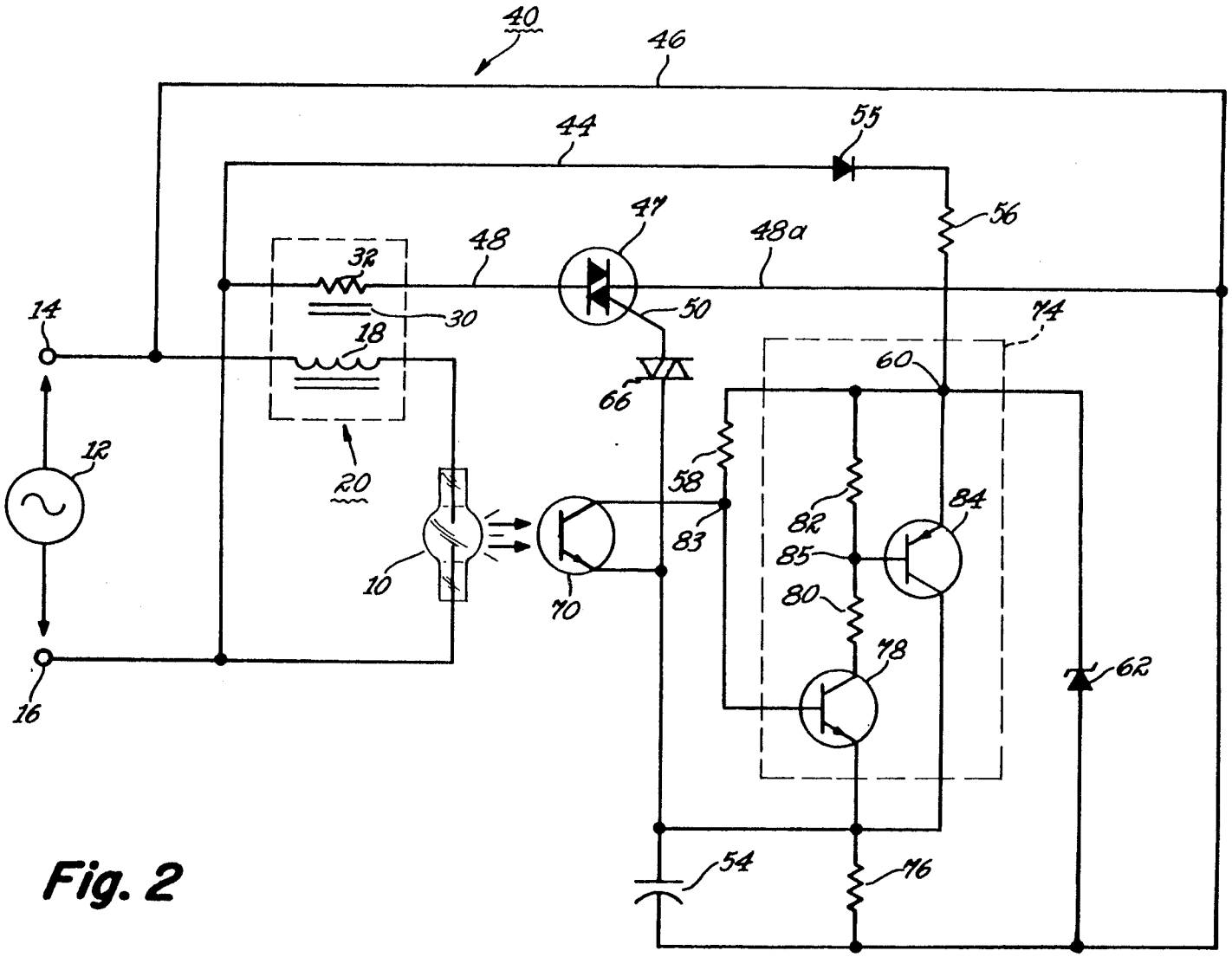
FIG. 2 is a diagrammatic showing of another lamp operating system including a control system embodying a first modified form of the invention.

The Embodiment of FIG. 2

It will be apparent from the above description that the circuit of FIG. 1 senses by means of a photocell 64 any change in lumens output from lamp 10, and by amplified negative feedback, it makes the necessary changes in heating element temperature to compensate for such changes, thereby maintaining the lumens output approximately constant.

The modified circuit of FIG. 2 accomplishes basically the same end result as the circuit of FIG. 1 but relies upon a silicon phototransistor instead of a cadmium sulfide photocell for sensing the light output of the lamp. Silicon phototransistors are inherently not as sensitive as cadmium sulfide photocells, but they are more stable with time, temperature, and light history. To compensate for this lack of sensitivity, the circuit of FIG. 2 utilizes a two-stage amplifier for amplifying the phototransistor's response to the incident light.

Referring more specifically to FIG. 2, the phototransistor is shown at 70, and the two-stage amplifier at 74. The components 10, 14, 16, 18, 20, 30, 32, 40, 44, 46, 47, 48, 48*a*, 50, 55, 56, 58, 60, and 62 in FIG. 2 correspond to correspondingly designated components in the circuit of FIG. 1. The two resistors 56 and 58, the rectifier 55, and the phototransistor 70 of FIG. 2 are connected in series with each other, and this series combination is connected in series with a timing capacitor 54 paralleled by a resistor 76.

The two-stage amplifier 74 comprises a first stage comprising the series combination of an NPN transistor 78 and two resistors 80 and 82 connected in parallel with the phototransistor 70 and resistor 58. The base of transistor 78 is connected to the junction point 83 between resistor 58 and phototransistor 70. The second stage of the amplifier comprises a PNP transistor 84 connected in parallel with the first stage and having its base connected to the junction point 85 between the resistors 80 and 82 of the first stage.

Under steady-state conditions, the phototransistor 70 is illuminated with a predetermined constant value of lumens, thus developing a predetermined voltage at junction point 83, which results in a predetermined current through the base of the second-stage amplifying transistor 84. This base current allows transistor 84 to effectively conduct, and this allow the timing capacitor 54 to be charged through the series combination of resistor 56 and the transistor 84. When the voltage across the timing capacitor 54 reaches a predetermined value, the breakdown device 66 avalanches and allows the capacitor to discharge through the gate 50 of the triac 47 and the circuit portion 48*a*. This fires the triac 47 and allows a pulse of current through the heating element 32 via circuit 48.

When the timing capacitor 54 has thus discharged, the triac 47 turns off, and charging of the timing capacitor 54 resumes through the resistor 56 and transistor 84. During this charging period, when the triac is off, no current flows through the heating element 32. But when the charge on the capacitor 54 reaches a predetermined voltage level, the above described cycle of events is repeated. Thus under steady-state conditions the heating element is energized with current pulses separated by non-current intervals of controlled duration.

If for any reason the light to the phototransistor 70 increases (e.g., due to an increase in the a.c. voltage between terminals 14 and 16 that increases the lumens output of the lamp 10), then capacitor 54 is charged at a slower rate than before. This increases the time between successive pulses in the heater circuit 48, thus lowering the heating element temperature and thereby raising the inductive reactance of reactor 20, which results in lowering the lumens output of the lamp. Thus the circuit of FIG. 2, like that of FIG. 1, uses amplified negative feedback to maintain essentially constant lumens.

The following will describe more specifically how the circuit of FIG. 2 operates in response to an increase in lumens output above the desired preselected value. The increased light received by the phototransistor 70 causes the effective resistance of the phototransistor to decrease, thereby lowering the voltage at point 83. This ties the base of transistor 78 more closely to ground, thus reducing the current through transistor 78 via resistors 82 and 80. This, in turn, reduces the current through the second-stage transistor 84 so that the capacitor is not charged through transistor 84 as quickly as before.

In one specific embodiment of the system of FIG. 2, I have used components having the following properties, which are given strictly by way of example and not limitation:

| | |
|---|---|
| Voltage of source 12 | 120 volts a.c. |
| Rated wattage of lamp 10 | 50 watts |
| Resistance of heating element 32 | 280 ohms |
| Resistance of: | |
| resistor 58 | 1 mega-ohm |
| resistor 82 | 10 kilo-ohms |
| resistor 80 | 22 kilo-ohms |
| resistor 56 | 22 kilo-ohms |
| resistor 76 | 56 kilo-ohms |
| Capacitance of capacitor 54 | .0082 microfarads |
| Breakdown device 66 | SBS |
| Switching device 47 | triac |
| Phototransistor 70 | silicon phototransistor, General Electric Co. type GEL14G1 |
| Transistor 78 | NPN transistor, type NN3904 |
| Transistor 84 | PNP transistor, type NN3906 |
| Breakdown voltage of Zener diode | 18 volts |

-continued

Figure 3:
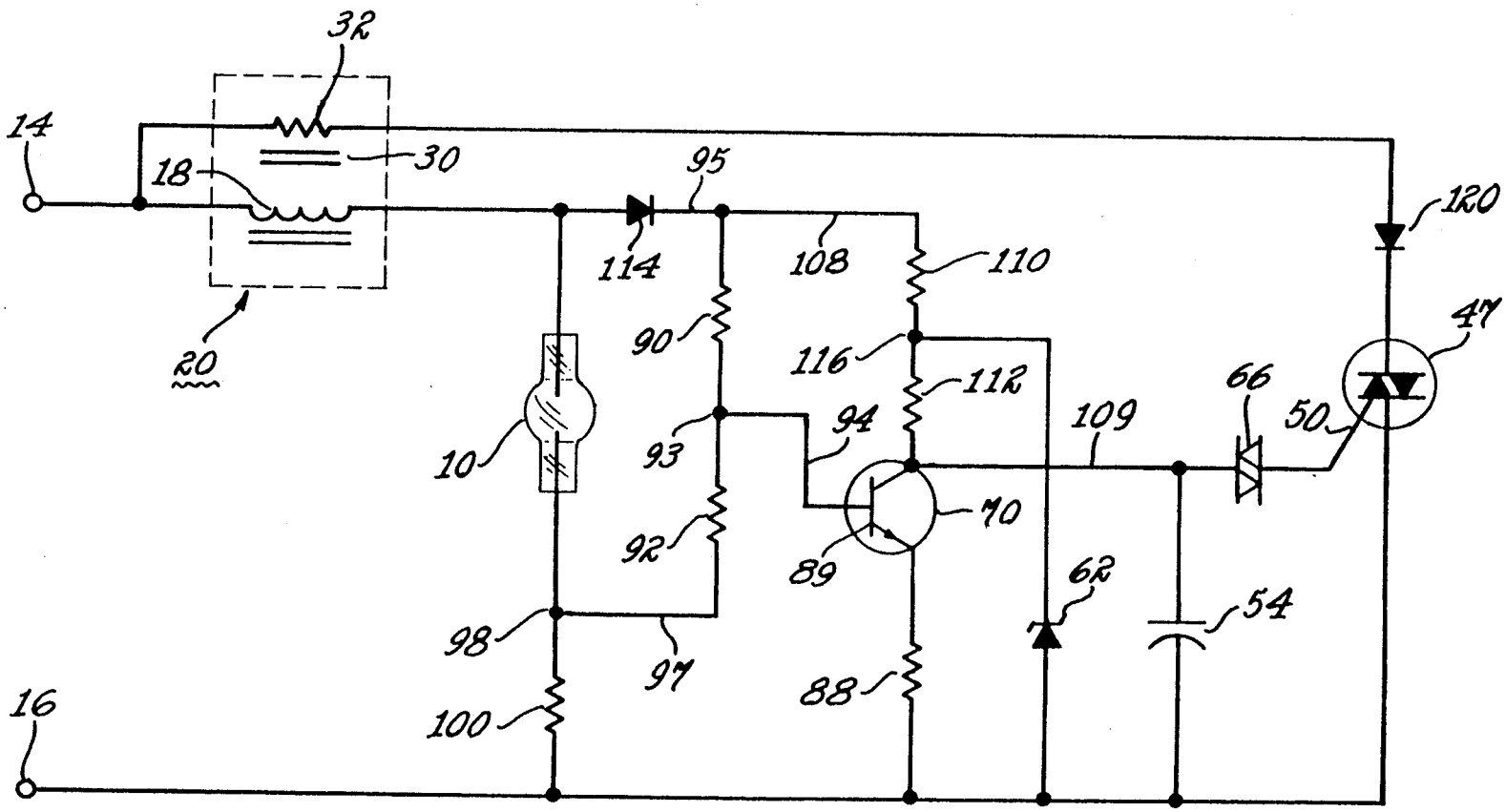
FIG. 3 shows still another lamp operating system including a control system embodying a second modified form of the invention.

The Embodiment of FIG. 3

FIG. 3 illustrates a modified form of the invention which is utilized for controlling lamp power instead of lumens output, as in FIGS. 1 and 2. In the circuit of FIG. 3, the following reference numerals are used to designate components corresponding to identically designated components in FIGS. 1 and 2: 10, 14, 16, 18, 20, 30, 47, 50, 54, 62, and 66.

In FIG. 3 the timing capacitor 54 is connected across the lamp via a circuit 108, 109 that includes the series combination of two resistors 110 and 112 and a rectifier 114. The junction point 116 between the two resistors is maintained at a fixed voltage with respect to terminal 16 by a Zener diode 62 that is connected between junction point 116 and terminal 16. Connected across the timing capacitor 54 is the series combination of a control transistor 70 and a resistor 88. The timing capacitor 54 is charged through the rectifier 114 and the resistors 110, 112 until the voltage across the timing capacitor reaches a predetermined value, at which time the breakdown device 66 avalanches and allows triggering current through the gate 50 of triac 47. This fires the triac, thus allowing a pulse of current through the heater element 32 via the triac and a rectifier 120 connected in series with the triac.

The rate at which the timing capacitor 54 is recharged is controlled by the control transistor 70 connected thereacross. The control transistor 70 is controlled by a signal applied to its base 89 which is representative of the power supplied to the lamp 10.

This signal representative of lamp power is developed by combining two other signals, one representative of the voltage across the lamp and the other representative of the in-phase current through the lamp. For deriving the signal representative of lamp voltage, a voltage divider comprising the series combination of two resistors 90 and 92 and a tap connection 93 between them is connected across the lamp. This series combination is connected into the lamp circuit via an upper conductor 95 containing rectifier 114 and a lower conductor 97 connected at junction point 98 to the lamp circuit. The tap connection 93 is connected through a conductor 94 to the base 89 of transistor 70. For deriving a signal representative of the current through the lamp, a low ohmic resister 100 is connected in series with the lamp 10 beneath the junction point 98. The voltage on conductor 97 (and correspondingly on conductor 94) varies directly with the IR drop across the resistor 100. If the lamp voltage increases, the input voltage to the base 89 of the control transistor 70 increases, and if the lamp current increases, the input voltage to the base 89 also increases. These increases in voltage on the transistor base increase the conductance of the transistor and thus decrease the voltage applied to conductor 109 and supplying the timing capacitor 54. This results in the timing capacitor charging less rapidly, which, in turn, results in the triac 47 being fired less often, i.e., the time intervals between successive current pulses through the triac are increased in length.

Lengthening these time intervals results in the heating element 32 and the ferrite yoke becoming cooler and the inductance of the reactor 20, correspondingly increasing, thereby reducing the lamp power. Tests made on the circuit of FIG. 3 have shown that for a line voltage change of +5% the lamp power changed less than 2%. With a conventional lamp circuit containing an uncontrolled reactor, a +5% change in line voltage results in a ±13% change in lamp power.

In one specific embodiment of the circuit of FIG. 3, I have used components having the following properties, which are set forth strictly by way of example and not limitation:

| | |
|---|---|
| Voltage of source 12 | 120 volts a.c. |
| Rated wattage of lamp | 50 watts |
| Resistance of heating element 32 | 280 ohms |
| Resistance of: | |
| resistor 90 | 42.7 kilo-ohms |
| resistor 92 | 408 ohms |
| resistor 100 | 0.6 ohms |
| resistor 88 | 5.6 kilo-ohms |
| resistor 110 | 22 kilo-ohms |
| resistor 112 | 39 kilo-ohms |
| Capacitance of capacitor 54 | .044 microfarads |
| Transistor 70 | NPN transistor, type NN3904 |
| Breakdown device 66 | SBS |
| Switching device 47 | Triac |
| Zener diode 62 voltage | 15 volts, breakdown |

GENERAL COMMENTS

Figure 5:
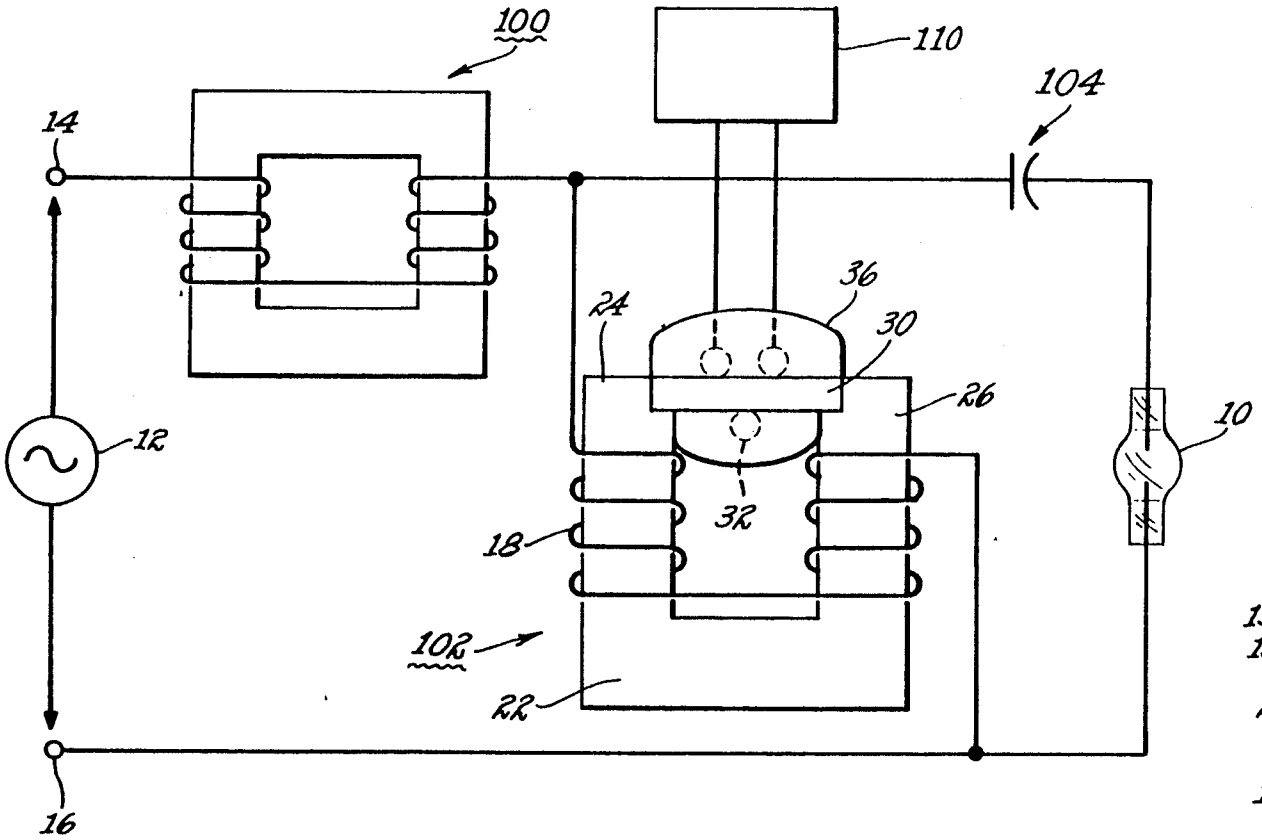
FIG. 5 shows still another lamp operating system including a control system embodying a third modified form of the invention.

Although I have shown in FIGS. 1–3 lighting systems in which the controlled reactor has its winding connected in series circuit relationship with the lamp, it is to be understood that my invention also has application to systems in which the controlled reactor is connected in parallel with the lamp. Such a system is shown in FIG. 5. This system includes a ballast of the autoregulator type that comprises two reactors, one shown at 100 having a winding connected in series with the lamp 10 and the other shown at 102 having a winding connected in parallel with the lamp. Also included in this ballast is a series capacitor 104 connected in series with the lamp 10.

The reactor 100 is an uncontrolled reactor. The other reactor 102 is constructed in essentially the same manner as the reactor 20 of FIG. 1, and the parts of the reactor 102 are designated with the same reference numerals as corresponding parts in the reactor of FIG. 1. The control circuit for the heater 32 of FIG. 5 is designated 110. The details of this circuit 110 are not shown since they are similar to those of the control circuit of FIG. 1. The control circuit 110 of FIG. 5 operates like the control circuit of FIG. 1 to change the inductance of the reactor in response to variations in the lumens output of the lamp 10, effecting such changes in inductance by heating and permitting cooling of the ferrite yoke portion 30. But instead of varying the inductance of the reactor as a direct function of the lumens output of the lamp 10, as in FIG. 1, the present control circuit varies the inductance as an inverse function of the lumens output of the lamp. When the lumen output increases above a preselected level, the control circuit 110 causes a decrease in the inductance of the controlled reactor 102. Conversely, when the lumen output is below this preselected level, the control circuit 110 causes an increase in the inductance of the controlled reactor 102 thereby increasing the current through lamp 10.

A significant feature of the heater-ferrite control present in these control systems is that the heating pulses are not required to be sine waves or to have any other particular shape. These pulses could be spikes (negative or positive), could be in phase or out of phase with the lamp current, or could be regularly-occurring or irregularly-occurring. It is the heating effect of these pulses that controls corrective action in the feedback control system, and the thermal mass of the ferrite yoke, in effect, integrates the heating effect of the individual pulses, thereby compensating for variations in the pulse shape or spacing.

The above feature of the control system enables me to rely upon a hybrid half-wave control network for controlling an alternating current lamp.

In a preferred form of my invention, the control system while in operation limits temperature variations of the ferrite portion to the above-described temperature range just below the Curie point. (With the ferrite material of FIG. 4, this temperature range is about 85–89 degrees C.). It is to be understood, however, that greater temperature variations could be allowed without interfering with the desired operation of the reactor or control system. The extremes of these greater temperature variations would simply produce little or no further change in permeability of the ferrite. But irrespective of the magnitude of the temperature variations allowed, the quiescent control temperature should still lie within the above-desired temperature range so that the principal operation of the reactor and the control system occurs within such range.

Although I have described my control system as regulating, in one case, lumens output and, in another case, lamp power, it will be apparent that other quantities associated with lamp operation can be regulated in generally the same manner with a control system of this type. Examples of such quantities are lamp voltage and lamp current. In such systems the reactor 20 will be the same as shown but appropriate modifications are needed to provide suitable sensing means for the quantity being regulated.

It is to be noted that the operation of my control system is not affected by the condition of the lamp as the lamp ages. For example, in the systems of FIGS. 1 and 2, whether the lumens output of the lamp changes as a result of changing lamp characteristics or changing, input to the lamp circuit, the control system still acts in the same manner to regulate lumens output.

Figure 6:
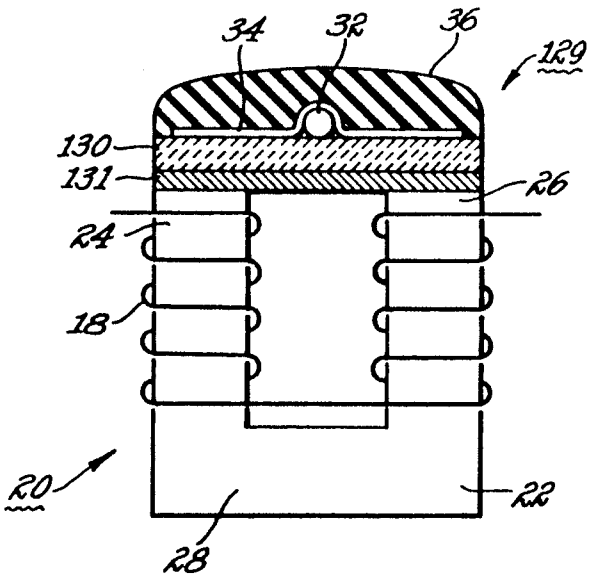
FIG. 6 shows the construction of the yoke of FIG. 5.

Although I have shown in FIG. 1 the yoke 30 of my reactor as constructed substantially entirely of ferrite material, it is to be understood that my invention in its broader aspects comprehends a reactor in which such yoke is constructed only partially of ferrite material. For example, the yoke could comprise two or more parts connected in series in the magnetic circuit and only one of these parts being of ferrite material. As another example, the yoke could comprise two magnetically parallel portions, one being of ferrite material and the other of metallic magnetic material. FIG. 6 illustrates this latter construction, where a reactor 20 having a yoke 129 is shown. This yoke 129 comprises a ferrite portion 130 and another portion 131 of steel in parallel with the ferrite portion in the magnetic circuit of the reactor. The other portions of the FIG. 5 reactor generally correspond to similar portions of the reactor of FIG. 1 and are designated with corresponding reference numerals.

It is also noted that in the variations of the invention described in the immediately preceding paragraph, the portion of the yoke referred to as being of ferrite could be of a suitable metallic material having a low Curie point.

While this control technique utilizing heater and low Curie point material is especially adapted to control lamps, it also has application to other types of control systems, e.g., systems for controlling temperatures, motor speeds, and other parameters. My invention in its broader aspects is intended to comprehend such control systems as well as variations of the illustrated control systems that include my controllable reactor, with its heater-low Curie point material control.

While I have shown and described particular embodiments of my inventions, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. A lighting system comprising:
(a) a lamp through which electric current flows to operate said lamp,
(b) a ballast reactor comprising a core and a winding inductively coupled to said core for developing a magnetic field in the core when the winding is traversed by electric current,
(c) means for connecting said winding in series circuit relationship with said lamp and in which:
(d) said reactor core forms a magnetic circuit for said magnetic field comprising two parts in series with each other in said magnetic circuit, one part being of a first magnetic material and the other being of a second magnetic material having a Curie point substantially lower than that of said first magnetic material, and
(e) means for varying the temperature of at least a portion of said second magnetic material part in a predetermined temperature range just below the Curie point thereof where the relative permeability of the second magnetic material decreases comparatively steeply in response to small temperature increases, comprising:
(e1) heating means in heat-exchange relationship with said second magnetic material portion, and
(e2) control means for causing said heating means to raise the temperature of said second magnetic material portion within said predetermined temperature range in response to predetermined system conditions and for causing the temperature of said second magnetic material portion to decrease within said predetermined range in response to other predetermined system conditions, thereby controlling the inductance of said reactor ballast and, as a result, controlling the performance of said lamp.

2. The lighting system of claim 1 in which:
(a) the core of said reactor comprises two spaced -apart legs and two yokes respectively located at opposite ends of said legs,
(b) said legs are of said first magnetic material, and
(c) at least one of said yokes is of said second magnetic material.

3. The lighting system of claim 2 in which said heating means comprises a heater located in heat exchange relationship with said second magnetic material yoke portion for developing heat when traversed by electric current.

4. The lighting system of claim 3 in which said heater is positioned adjacent said second magnetic material yoke portion and thermal insulation is provided about said heater for producing more efficient heat transfer from said heater to said second magnetic material yoke portion.

5. The lighting system of claim 4 in which said heating means further includes heat-distribution means of high thermal conductivity material positioned closely adjacent said heater and said second magnetic material yoke portion for distributing more uniformly over said second magnetic material yoke portion the heat developed by current through said heater.

6. The lighting system of claim 1 in which (a) said winding is connected in series with said lamp and (b) increasing the temperature of said second magnetic material portion causes the inductance of said reactor ballast to decrease, thus allowing more current through the series combination of said winding and said lamp.

7. The lighting system of claim 1 in which said control means acts to maintain the lumens output of said lamp substantially constant.

8. The lighting system of claim 1 in which (a) said winding is connected in series with said lamp and (b) said control means acts to increase the inductance of said reactor ballast in response to an increase in the lumens output of said lamp above a predetermined selected level and acts to decrease the inductance of said reactor ballast in response to a decrease in the lumens output of said lamp below said predetermined selected level, thereby maintaining said lumens output at substantially said predetermined level.

9. The lighting system of claim 8 in which said control means acts to decrease the inductance of said reactor ballast by increasing the temperature of said second magnetic material portion within said predetermined temperature range and acts to increase the inductance of said reactor by causing the temperature of said second magnetic material portion to decrease within said predetermined temperature range.

10. The lighting system of claim 1 in which said winding is connected in series circuit with said lamp, said heating means is electrical heating means, and said control means includes:
(a) means effective when said lamp is in operation for causing heating current to flow through said electrical heating means during intervals that are separated by intervening time periods of relatively low or no current, the length of said intervening time periods being controlled during steady-state conditions so that said second magnetic material portion is heated to a predetermined temperature $T_1$ within said predetermined temperature range, and
(b) means for varying the length of said intervening time periods in such a manner as to cause said heating current to heat said second magnetic material portion (i) to a lower temperature than $T_1$ when a regulated quantity of said lamp exceeds its steadystate value and (ii) to a higher temperature than $T_1$ when said regulated lamp quantity falls below said steady-state value.

11. The lighting system of claim 10 in which said regulated quantity is the lumens output of the lamp.

12. The lighting system of claim 10 in which said regulated quantity is the lamp power.

13. An operating system comprising:

(a) a device through which electric current flows to operate said device, (b) a ballast comprising a core and a winding inductively coupled to said core for developing a magnetic field in the core when the winding is traversed by electric current, (c) means for connecting said winding in circuit relationship with said device and in which:

(d) said core forms a magnetic circuit for said magnetic field comprising two parts in series with each other in said magnetic circuit, one part being of a first magnetic material and the other being of a second magnetic material having a Curie point substantially lower than that of said first magnetic material, and (e) means for varying the temperature of at least a portion of said second magnetic material part in a predetermined temperature range just below the Curie point thereof where the relative permeability of the second magnetic material decreases steeply in response to small temperature increases, comprising:

(e1) heating means in heat-exchange relationship with said second magnetic material portion, and (e2) control means for causing said heating means to raise the temperature of said second magnetic material portion within said predetermined temperature range in response to predetermined system conditions and for causing the temperature of said second magnetic material portion to decrease within said predetermined system conditions, thereby controlling the inductance of said ballast and, as a result, controlling the performance of said device.

14. The operating system of claim 13 in which:

(a) the core of said ballast comprises two spaced-apart legs and two yokes respectively located at opposite ends of said legs, (b) said legs are of said first magnetic material, and (c) at least a portion of one of said yokes is of said second magnetic material.

15. The operating system circuit of claim 14 in which said heating means comprises a heater located in heat-exchange relationship with said second magnetic material yoke portion for developing heat when traversed by electric current.

16. The operating system of claim 15 is which said heater is positioned adjacent said second magnetic material yoke portion and thermal insulation is positioned about said heater for producing more efficient heater transfer from said heater to said second magnetic material yoke portion.

17. The operating circuit of claim 16 in which said heating means further includes heat-distribution means of high thermal conductivity material positioned closely adjacent said heater and said second magnetic material yoke portion for distributing more uniformly over said ferrite yoke portion the heat developed by current through said heater.

18. The operating system of claim 13 in which said winding is connected in series circuit with said device, said heating means is electrical heating means, and said control means includes:

(a) means effective when said device is in operation for causing heating current to flow through said electrical heating means during intervals that are separated by intervening time periods of relatively low or no current, the length of said intervening time periods being controlled during steady-state conditions so that said second magnetic material portion is heated to a predetermined temperature $T_1$, and (b) means for varying the length of said intervening time periods in such a manner as to cause said heating current to heat said second magnetic material portion (i) to a lower temperature than $T_1$ when a regulated quantity associated with operation of said device exceeds its steady-state value and (ii) to a higher temperature than $T_1$ when said regulated quantity falls below said steady-state value.

19. The lighting system of claim 1 in which said second magnetic material is a ferrite.

20. The operating system of claim 13 in which said second magnetic material is a ferrite.

* * * * *